US007438641B2

(12) United States Patent
Hedrick

(10) Patent No.: US 7,438,641 B2
(45) Date of Patent: Oct. 21, 2008

(54) GAMING DEVICE WITH ROTATING AND TRANSLATING DISPLAY DEVICE

(75) Inventor: Joseph R. Hedrick, Reno, NV (US)

(73) Assignee: IGT, Reno, NV (US)

( * ) Notice: Subject to any disclaimer, the term of this patent is extended or adjusted under 35 U.S.C. 154(b) by 607 days.

(21) Appl. No.: 10/956,294

(22) Filed: Oct. 1, 2004

(65) Prior Publication Data

US 2006/0073875 A1 Apr. 6, 2006

(51) Int. Cl.
*A63F 9/24* (2006.01)

(52) U.S. Cl. ..... 463/30; 463/16; 463/20; 463/31; 463/32; 463/46; 463/47

(58) Field of Classification Search ..... 463/16, 463/20, 31, 46, 47; 273/143 R
See application file for complete search history.

(56) References Cited

U.S. PATENT DOCUMENTS

| | | | |
|---|---|---|---|
| 1,978,395 | A | 4/1934 | Groetchen |
| 2,545,644 | A | 3/1951 | Benton et al. |
| 3,420,525 | A | 1/1969 | Waders |
| 3,642,287 | A | 2/1972 | Lally et al. |
| 3,735,987 | A | 5/1973 | Ohki |
| 3,975,022 | A | 8/1976 | Figueroa |
| 4,326,351 | A | 4/1982 | Heywood et al. |
| D266,915 | S | 11/1982 | Metzinger |
| 4,410,178 | A | 10/1983 | Partidge |
| 4,448,419 | A | 5/1984 | Telnaes |
| 4,517,558 | A | 5/1985 | Davids |
| 4,695,053 | A | 9/1987 | Vazquez, Jr. et al. |
| 4,732,386 | A | 3/1988 | Rayfiel |
| 4,978,129 | A | 12/1990 | Komeda et al. |
| 5,058,893 | A | 10/1991 | Bertram et al. |
| 5,152,529 | A | 10/1992 | Okada |
| 5,364,100 | A | 11/1994 | Ludlow et al. |
| D355,624 | S | 2/1995 | Wiegand |
| 5,395,111 | A | 3/1995 | Inoue |
| 5,449,173 | A | 9/1995 | Thomas et al. |
| 5,560,603 | A | 10/1996 | Seelig et al. |
| 5,584,763 | A | 12/1996 | Kelly et al. |

(Continued)

FOREIGN PATENT DOCUMENTS

| | | | |
|---|---|---|---|
| EP | 1 003 138 | A | 5/2000 |

(Continued)

OTHER PUBLICATIONS

"Cylindrical Hot Air Balloon", from http://web.archive.org/web/19961025025312/http://www.aero.com/ballooning/commercial/images/rayovac.gif, available on the internet as of Oct. 25, 1996.*

(Continued)

*Primary Examiner*—John M Hotaling, II
*Assistant Examiner*—Steven J. Hylinski
(74) *Attorney, Agent, or Firm*—Bell, Boyd & Lloyd LLP

(57) ABSTRACT

A gaming device having a translating and rotating mechanical display device operable to indicate at least one component of a player's award. In one embodiment the display device is operated as a bonus game of a base game, for example a slot base game. In one embodiment, the object is rotatable and translatable along the same axis. In one embodiment, the object is balloon shaped.

31 Claims, 8 Drawing Sheets

U.S. PATENT DOCUMENTS 5,584,764 A 12/1996 Inoue
5,609,524 A 3/1997 Inoue
5,664,998 A 9/1997 Seelig et al.
5,722,891 A 3/1998 Inoue
5,752,881 A 5/1998 Inoue
5,788,573 A 8/1998 Baerlocher et al.
5,823,872 A 10/1998 Prather et al.
5,823,874 A 10/1998 Adams
D400,597 S 11/1998 Hedrick et al.
D402,702 S 12/1998 Seelig et al.
5,848,932 A 12/1998 Adams
5,863,249 A 1/1999 Inoue
D406,865 S 3/1999 Heidel
5,882,261 A 3/1999 Adams
5,911,418 A 6/1999 Adams et al.
5,927,714 A 7/1999 Kaplan
5,947,820 A 9/1999 Morro et al.
5,976,015 A 11/1999 Seelig et al.
5,984,782 A 11/1999 Inoue
5,997,401 A 12/1999 Crawford
6,004,207 A 12/1999 Wilson, Jr. et al.
6,056,642 A 5/2000 Bennett
6,059,658 A 5/2000 Mangano et al.
6,086,066 A 7/2000 Takeuchi et al.
6,089,977 A 7/2000 Bennett
6,089,978 A 7/2000 Adams
6,105,962 A 8/2000 Malavazos et al.
6,113,098 A 9/2000 Adams
6,135,884 A 10/2000 Hedrick et al.
6,142,873 A 11/2000 Weiss et al.
6,142,874 A 11/2000 Kodachi et al.
6,159,098 A 12/2000 Slomiany et al.
6,162,121 A 12/2000 Morro et al.
6,168,520 B1 1/2001 Baerlocher et al.
6,173,955 B1 1/2001 Perrie et al.
6,174,234 B1 1/2001 Seibert et al.
6,174,235 B1 1/2001 Walker et al.
D439,283 S 3/2001 Naranjo
6,203,429 B1 3/2001 Demar et al.
D441,031 S 4/2001 Seelig et al.
6,213,876 B1 4/2001 Moore, Jr.
6,220,593 B1 4/2001 Pierce et al.
6,224,483 B1 5/2001 Mayeroff
6,227,970 B1 5/2001 Shimizu et al.
D443,313 S 6/2001 Brettschneider
6,251,013 B1 6/2001 Bennett
6,254,481 B1 7/2001 Jaffe
6,261,177 B1 7/2001 Bennett
6,267,669 B1 7/2001 Luciano, Jr. et al.
6,270,411 B1 8/2001 Gura et al.
6,270,412 B1 8/2001 Crawford
6,302,790 B1 10/2001 Brossard
6,305,686 B1 10/2001 Perrie et al.
6,312,334 B1 11/2001 Yoseloff
6,315,663 B1 11/2001 Sakamoto
6,334,814 B1 1/2002 Adams
6,336,863 B1 1/2002 Baerlocher et al.
6,340,158 B2 1/2002 Pierce et al.
6,368,216 B1 4/2002 Hedrick et al.
6,386,974 B1 5/2002 Adams
6,398,220 B1 6/2002 Inoue
6,419,579 B1 7/2002 Bennett et al.
D462,397 S 9/2002 Baker et al.
6,461,241 B1 10/2002 Webb et al.
D465,531 S 11/2002 Luciano, Jr. et al.
6,481,713 B2 11/2002 Perrie et al.
6,517,432 B1 2/2003 Jaffe
6,533,273 B2 3/2003 Cole et al.
6,533,660 B2 3/2003 Seelig et al.
6,537,152 B2 3/2003 Seelig et al.
6,582,307 B2 6/2003 Webb
6,589,114 B2 7/2003 Rose
6,609,972 B2 * 8/2003 Seelig et al. ..... 463/16
6,612,574 B1 9/2003 Cole et al.
6,612,575 B1 9/2003 Cole et al.
6,638,167 B1 10/2003 Sawyer et al.
6,659,864 B2 12/2003 McGahn et al.
6,712,694 B1 3/2004 Nordman
6,715,756 B2 4/2004 Inoue
6,726,204 B2 4/2004 Inoue
D496,968 S 10/2004 Baerlocher
6,854,732 B2 2/2005 Moody
6,974,129 B2 * 12/2005 Nordman ..... 273/143 R
D523,908 S 6/2006 Hedrick et al.
7,169,045 B2 * 1/2007 Nordman ..... 463/20
7,241,220 B2 * 7/2007 Rothkranz et al. ..... 463/20
2001/0024971 A1 9/2001 Brossard
2001/0054794 A1 12/2001 Cole et al.
2002/0094862 A1 7/2002 Inoue
2002/0142829 A1 10/2002 Inoue
2003/0083121 A1 5/2003 Cole et al.
2003/0232643 A1 12/2003 Inoue
2004/0000754 A1 * 1/2004 Inoue ..... 273/143 R
2004/0012145 A1 1/2004 Inoue
2004/0014516 A1 1/2004 Inoue
2004/0014517 A1 1/2004 Inoue
2004/0017041 A1 1/2004 Inoue
2004/0018866 A1 1/2004 Inoue
2004/0026854 A1 2/2004 Inoue
2004/0036218 A1 2/2004 Inoue
2004/0038726 A1 2/2004 Inoue
2004/0041340 A1 3/2004 Inoue
2004/0053658 A1 3/2004 Rothkranz
2004/0082373 A1 4/2004 Cole et al.
2004/0121840 A1 6/2004 Rosander et al.
2004/0214630 A1 10/2004 Mayeroff
2005/0020348 A1 1/2005 Thomas et al.

FOREIGN PATENT DOCUMENTS

GB 2 201 821 A 9/1988

OTHER PUBLICATIONS

4DU Dice Unit Advertisement, written by starpoint.uk.com, printed on Sep. 3, 2002.
American Bandstand Brochure, written by Anchor Games, published in 2001.
American Bandstand Article, written by Strictly Slots, published in Jan. 2002.
Austin Powers in Goldmember™ Advertisement, written by IGT, published in 2003.
Bonus Roulette Brochure, written by R. Franco, published prior to 2004.
Buck's Roulette Brochure, written by R. Franco, published prior to 2004.
Easy Street Advertisements and Articles, written by Casino Data Systems, published in 2000.
Jack and the Beanstalk™ Brochure, written by AC Coin & Slot, published prior to 2004.
King of the Grill™ Brochure, written by AC coin & Slot, published prior to 2004.
Line-Up Brochure, written by AC Coin & Slot, published prior to 2004.
Magic 8 Ball Advertisement, written by IGT, published in 2002.
Miss America Brochure, written by AC Coin & Slot, published prior to 2004.
Mix and Match Advertisement, published by AC Coin & Slot, published prior to 2004.
Mix and Match Article, written by Strictly Slots, published in Apr. 2002.
Monster Match Article, written by Strictly Slots, published in Jan. 2002.
Power Slotto Brochure, published by AC Coin & Slot prior to 2002.

R&B™ Brochure, published by AC Coin & Slot, published prior to 2004.

Reel Dice Advertisement, written by Gerber & Glass, published in 1936.

Royal Roulette Brochure, written by Impulse Gaming Ltd., published prior to 2004.

Silver City Roundup Brochure, published by AC Coin & Slot, published prior to 2004.

Slot Machine Buyer's Handbook, A Consumer's Guide to Slot Machines, written by David L. Saul and Daniel R. Mead, published in 1998.

Slot Machines A Pictorial History of the first 100 Years, 5th Edition written by Marshall Fey, published in 1983-1997.

Slot Machines on Parade, 1st Edition written by Robert N. Geddes and illustrated by Daniel R. Mead, published in 1980.

Spin-A-Lot Brochure, written by Acres Gaming Incorporated, published prior to 2001.

Take Your Pick Article, written by IGT/Anchor Games, Strictly Slots, published in 1999.

Treasure Wheel/Treasure Tunnel Advertisement, written by Sigma Game, Inc., published prior to 2000.

Wheel of Fortune Advertisement, written by IGT, published in 1998.

* cited by examiner

GAMING DEVICE WITH ROTATING AND TRANSLATING DISPLAY DEVICE

This application is related to the following commonly-owned co-pending patent applications: "GAMING DEVICE DISPLAY," Ser. No. 29/255,602.

BACKGROUND OF THE INVENTION

The present invention relates to gaming devices. More particularly, the present invention relates to wagering gaming device displays.

Gaming devices, such as slot machines and video poker machines, provide fun and excitement for the player. Gaming, in general, provides an escape from the everyday rigors of life. Gaming devices and gaming establishments use bright lights and exciting sounds to set the gaming world apart from the rest of the world. Gaming devices, in particular, use one or more displays that enable the player to see, play and interaction with the game. The displays typically portray the action of the game and ultimately indicate whether or not the player wins.

Slot machine and other gaming device displays have gone through a number of transitions since their inception. Originally, slot machines displayed purely mechanical reels. While these machines gained enormous popularity, the mechanical nature of the reels limited the number of paystops, which limited the number of different symbols and the number of different winning symbol combinations.

The advent of the computer and the video monitor expanded the possibilities for gaming devices. There are now video poker, video blackjack and other types of video gaming machines. Video displays have also been implemented in slot machines. The video slot machines use computers to randomly generate symbol combinations from an expanded number of different symbols. Video reel strips can include a virtually unlimited number of symbols, which enables a wide variety of different symbol combinations to be employed, including combinations that appear very infrequently and yield high payouts.

With slot machines, the video monitors have also been used to provide bonus or secondary games. Bonus games in gaming machines have become much more prevalent and elaborate in recent years. For example, players play the base game of slot until becoming eligible for a bonus game. The base game temporarily pauses, while the player plays the bonus game. When the player completes the bonus game, the gaming device returns the player to the bonus game.

It should therefore be appreciated that a single video monitor is often sufficient to provide both the base game of slot and one or more bonus games that become triggered by the slot game. As illustrated in FIG. 1, there is room on the cabinet of gaming device 10 for an upper display area 132. That area, however, is often not utilized for gaming purposes and may simply provide a paytable, graphics and/or lettering that pertains to a theme of the gaming device.

Video monitors and in particular video-based slot machines are likely going to continue growing in popularity. As the video monitor has been used more and more, however, there has been a growing sentiment that some of the mystique of the old time mechanical gaming devices is lost when mechanical reels and mechanical displays are replaced by a video monitor.

Accordingly, a need exists to provide new gaming devices that may use a video monitor which provides increased flexibility to the gaming device to add more symbols and more elaborate bonus games, while providing some aspect of the gaming device that is mechanical and provides a fun and exciting mechanical display of symbols such as awards.

SUMMARY OF THE INVENTION

The present invention provides a display device for a gaming device and in one embodiment a mechanical display for a slot machine. The display device includes an object that is rotated and translated. The object includes and displays a plurality of symbols. As the object is rotated, the player can see different ones of the symbols. In one embodiment, the translation of the object indicates to the player that an award based on one of the symbols is imminent. In one embodiment, when the object stops rotating and translating, the display device designates one or more of the symbols to be provided to the player such as an award or a component of an award.

In one embodiment, the display device includes a secondary random generation that produces an outcome that is combined with the designated symbol or symbols of the object. For example, the symbols can designate a credit value and the secondary random generation can designate a modifier such as a multiplier. That is, the translational and rotational motion of the object yields a designated credit value, while the secondary random generation yields a designated multiplier. The credit value and multiplier are combined to provide an overall award for the player. In one alternative embodiment, this is reversed such that the symbols designate a modifier such as a multiplier and the secondary random generation yields an award. Other awards may be provided instead of credit values or multipliers, such as a number of picks from a prize pool, a number of free games, a non-monetary award and any combination thereof. In an alternative embodiment, the rotating and translating object designates a multiplier and the secondary random generation designates a credit value.

In one embodiment, the display device is provided in combination with a base game, such as the base game of slot. The display device alternatively cooperates with any suitable base game such as poker, blackjack, craps, keno, bingo, bunco and any combination thereof. The display device can, for example, be provided as an upper display area or top box on the slot machine or other type of base game device. The base game device can also have various configurations such as a vertical or slanted video monitor that displays the base game to the player. In a further alternative embodiment, the base game is provided via a mechanical or electro-mechanical apparatus, such as mechanical slot machine reels.

In one embodiment, the outcome of a random spinning of slot machine reels yields a triggering symbol or combination of symbols that triggers the movement of the object. In one embodiment, the object begins to simultaneously translate and rotate. The object can translate in a single or multiple directions and rotate in a single or multiple directions. Upon completion of a motion program stored in the memory of the gaming device, the object comes to a stop and one or more of the symbols of the object is displayed. The player is provided an award as a bonus award, which can be in addition to an award provided by the base game.

In the embodiments illustrated herein, the object is in the form or shape of a hot air balloon. Upon a triggering event, the hot air balloon begins to rise and also begins rotating. The hot air balloon continues to rise and rotate to a predetermined or randomly determined translational and rotational position. The balloon displays a plurality of credit values, one of which is ultimately designated by an indicator, for example, an arrow or pointer attached to the display device. The balloon is housed within a fully or partially see-through or transparent cover made from a suitable material such as glass, plexiglas, acrylic or another suitable polymer. In one embodiment, the indicator or pointer is affixed to the cover.

In one embodiment, series of multipliers is displayed adjacent to the hot air balloon and see-through cover on a front panel of the cabinet of the gaming device. Behind the multipliers, the display device provides a plurality of lights. While the balloon rises and rotates, the gaming device sequentially lights different ones of the multipliers of the display device. Ultimately, one of the multipliers remains lighted. The player's award is the designated credit value multiplied by the lighted multiplier.

In an alternative embodiment, the object or hot air balloon includes an indicator that translates with the object. When the object stops moving, the indicator points to or otherwise indicates one of the awards displayed adjacent to the object such as a multiplier. The multiplier combines with the award indicated due to the rotation of the object to form an overall award for the player.

In one embodiment, separate motion producing devices, such as rotational stepper motors, provide the translational and rotational motion of the object individually. For example, one stepper motor rotates a lead screw that threads into a tapped hole or nut welded to a plate. The plate supports a second motor that drives a belt. The first stepper motor translates the object or balloon up or down (or alternatively side to side). The second stepper motor rides with the object or balloon and rotates the belt, wherein the belt is coupled to the object or balloon. When the second motor is energized, the rotation of the shaft of the second motor turns a pulley, which in turn drives the belt, which in turn rotates the object or balloon. That configuration illustrated further below drives the balloon in the desired translational and rotational manner and is also relatively easily hidden from the player, so as to make the object or balloon appear to float and turn as it is floating. The partially see-through cover is colored sky blue and painted with clouds in the rear so as to make the balloon appear to be floating in the sky. It should be appreciated that other suitable drive mechanisms may be employed to simultaneously rotate and translate the object in accordance with the present invention.

It is therefore an advantage of the present invention to provide a fun and interesting gaming device display.

It is another advantage of the present invention to provide a fun and interesting apparatus and method of designating a symbol such as an award for a player.

It is a further advantage of the present invention to provide a display device that rotates and translates simultaneously in a fun and entertaining manner.

It is still another advantage of the present invention to provide an apparatus that rotates to determine one component of the player's award and translates to determine another component of the player's award.

It is yet another advantage of the present invention to provide a motion control configuration that rotates and translates an object of a display device.

Additional features and advantages of the present invention are described in, and will be apparent from, the following Detailed Description of the Invention and the figures.

DETAILED DESCRIPTION OF THE INVENTION

The present invention provides a display device that operates with a multitude of primary or base wagering games, including but not limited to the games of slot, poker, keno, blackjack, craps and bunco. In an embodiment, the display device operates in conjunction with one or more secondary or bonus games, which in turn operate in conjunction with a primary or base game. Besides such base and bonus games, the present invention is operable with any of the bonus triggering events, as well as any progressive game coordinating with those base games. The symbols and indicia used for any of the primary or base games, bonus or secondary games or progressive games include any suitable symbols, images or indicia.

Figure 1:
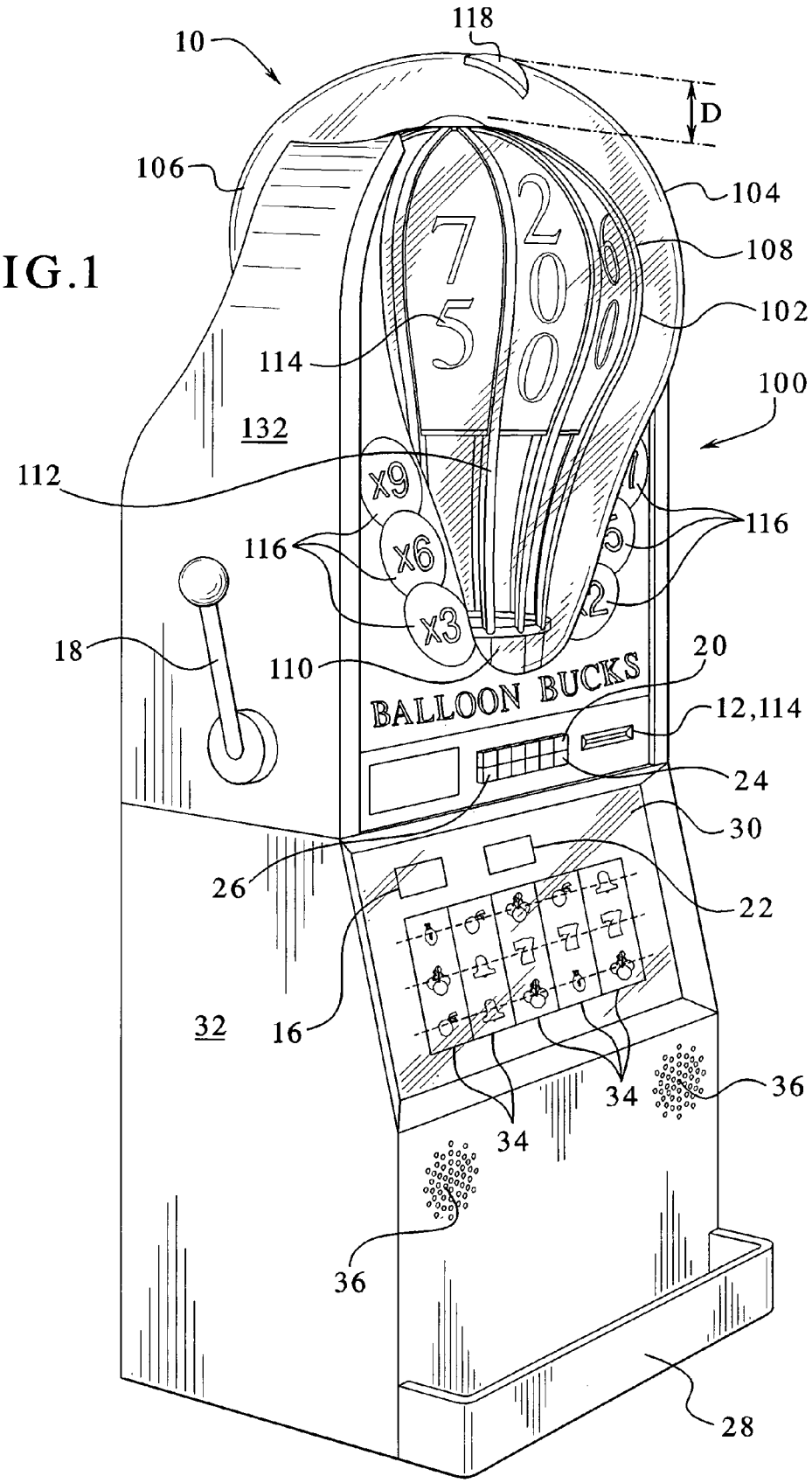
FIG. 1 is a perspective view of one embodiment of the gaming device of the present invention.
Figure 2:
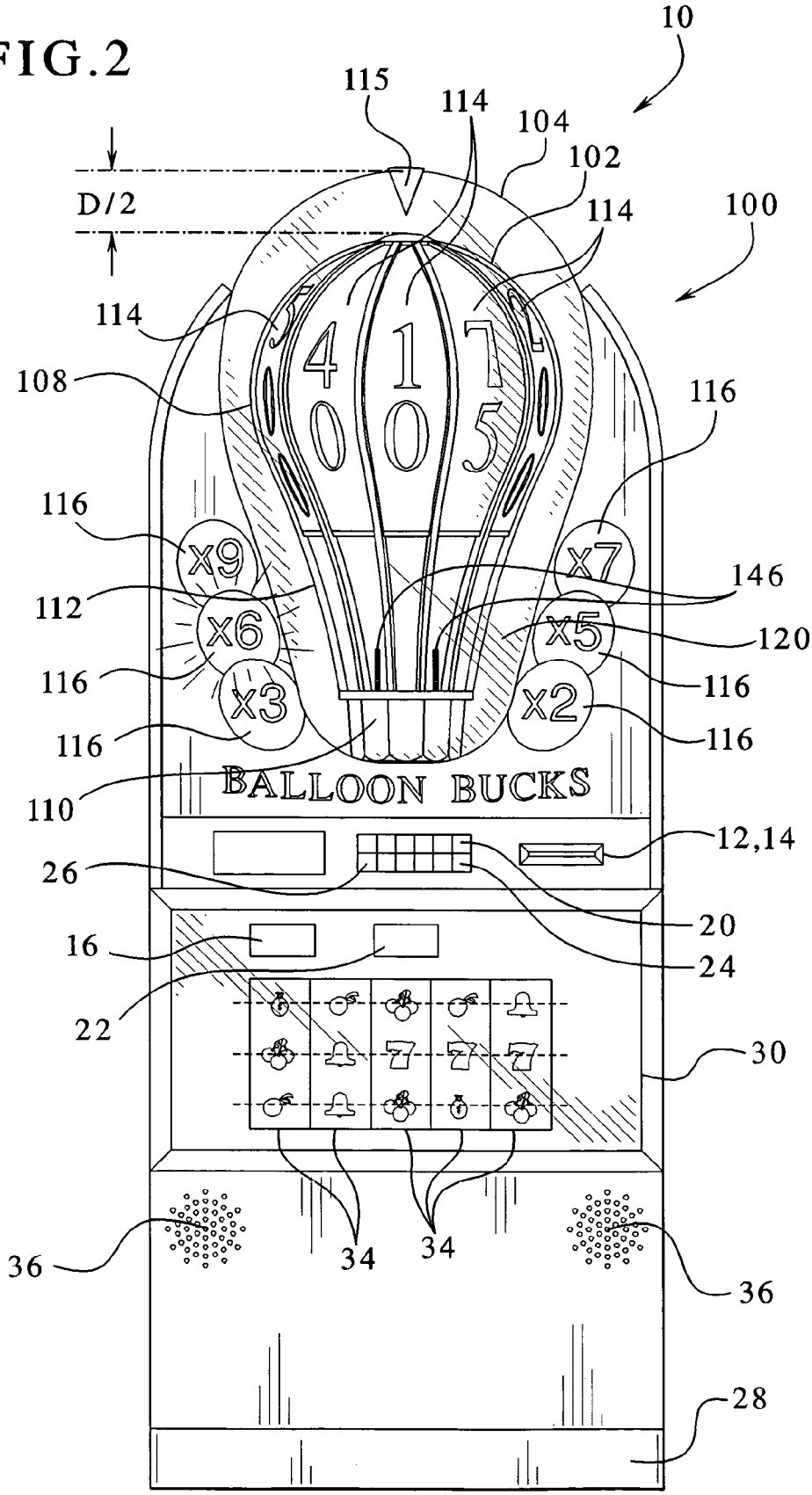
FIG. 2 is an elevation view of the embodiment of the gaming device illustrated in FIG. 1, wherein a moving object of the display has moved translationally and rotationally to an intermediate position.
Figure 3:
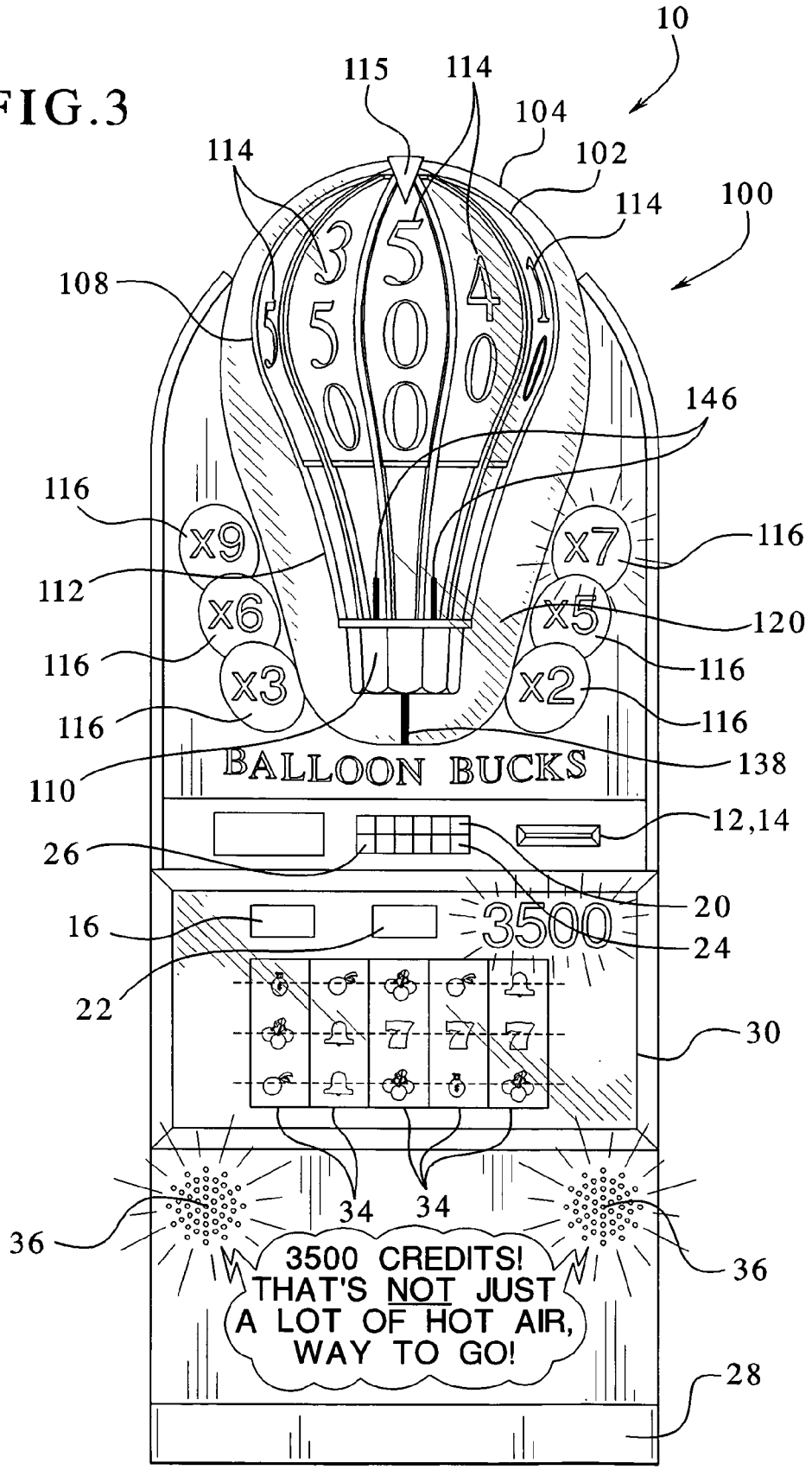
FIG. 3 is an elevation view of the embodiment of the gaming device illustrated in FIGS. 1 and 2, wherein the moving object of the display has moved translationally and rotationally to an end position.

One primary embodiment for the display device is with a slot game. Referring now to the drawings, and in particular to FIGS. 1 to 3, one slot machine embodiment is illustrated by gaming device 10. Gaming device 10 has the controls, displays and features of a conventional slot machine, wherein the player operates the gaming device while standing or sitting. Gaming device 10 can also be a pub-style or table-top game (not shown), which the player operates while sitting.

Gaming device 10 includes monetary input devices. FIGS. 1 to 3 illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player that starts a game or sequence of events in the gaming device. The buttons of the present invention are simulated on a touch screen, electromechanical or provided in both forms.

As shown in FIGS. 1 to 3, gaming device 10 also includes a bet display 22 and a bet one button 24. The player places a bet by pushing the bet one button 24. The player increases the bet by one credit each time the player pushes the bet one button 24. When the player pushes the bet one button 24, the number of credits shown in the credit display 16 decreases by one, and the number of credits shown in the bet display 22 increases by one. The player cashes out by pushing a cash out button 26 to receive coins or tokens in the coin payout tray 28 or other forms of payment, such as an amount printed on a ticket or credited to a credit card, debit card or smart card.

Well known ticket printing and card reading machines (not illustrated) are commercially available.

Gaming device 10 also includes one or more display devices. The embodiments shown in FIGS. 1 to 3 include a display device 30, which is provided in a lower gaming area 32 of gaming device 10. A display device 100, which is the subject of the present invention, is provided in an upper display or top box area 132 in one embodiment.

Display device 30 includes any viewing surface such as glass, a video monitor or screen, a liquid crystal display or any other static or dynamic, video, mechanical or electromechanical, display mechanism. In a video poker, blackjack or other card gaming machine embodiment, display device 30 displays one or more cards. In a keno embodiment, the display device displays numbers.

In one preferred embodiment, display device 30 displays the game of slot. The slot machine embodiment of gaming device 10 includes a plurality of reels 34, for example three to five reels 34. Reels 34 can be simulated on a video monitor, be purely mechanical or be electromechanical. Each reel 34 includes a plurality of indicia, such as bells, hearts, fruits, numbers, letters, bars or other images that correspond to a theme associated with gaming device 10.

Gaming device 10 includes speakers 36 for making sounds or playing music. Speakers 36 can provide voice guidance instructions, instruct the player of a win and provide sounds in accordance with a game theme (e.g., famous person's voice used in a gaming device featuring such famous person).

With reference to the slot machine base game of FIGS. 1 to 3, to operate gaming device 10, the player inserts the appropriate amount of tokens or money in coin slot 12 or payment acceptor 14 and then pulls arm 18 or pushes play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any suitable base games, also includes any suitable bonus games that give players the opportunity to win additional credits. Gaming device 10 in one embodiment uses the video-based display device 30 for the bonus games. Otherwise or additionally, the bonus game is carried out on display device 100. The bonus games include a program that automatically begins when the player achieves a qualifying condition in the base game.

In the illustrated embodiment, the display device 100 of the present invention is provided in the upper display or top box area 132. Display device 100 is provided, in another embodiment, on top of a rounded or rectangular cabinet of gaming device 10, so that the upper display or top box area 132 can be used for other gaming purposes. Other gaming purposes include, without limitation, the provision of another electromechanical or video display device (not illustrated) or the provision of game information, e.g., a paytable or game instruction.

Figure 4:
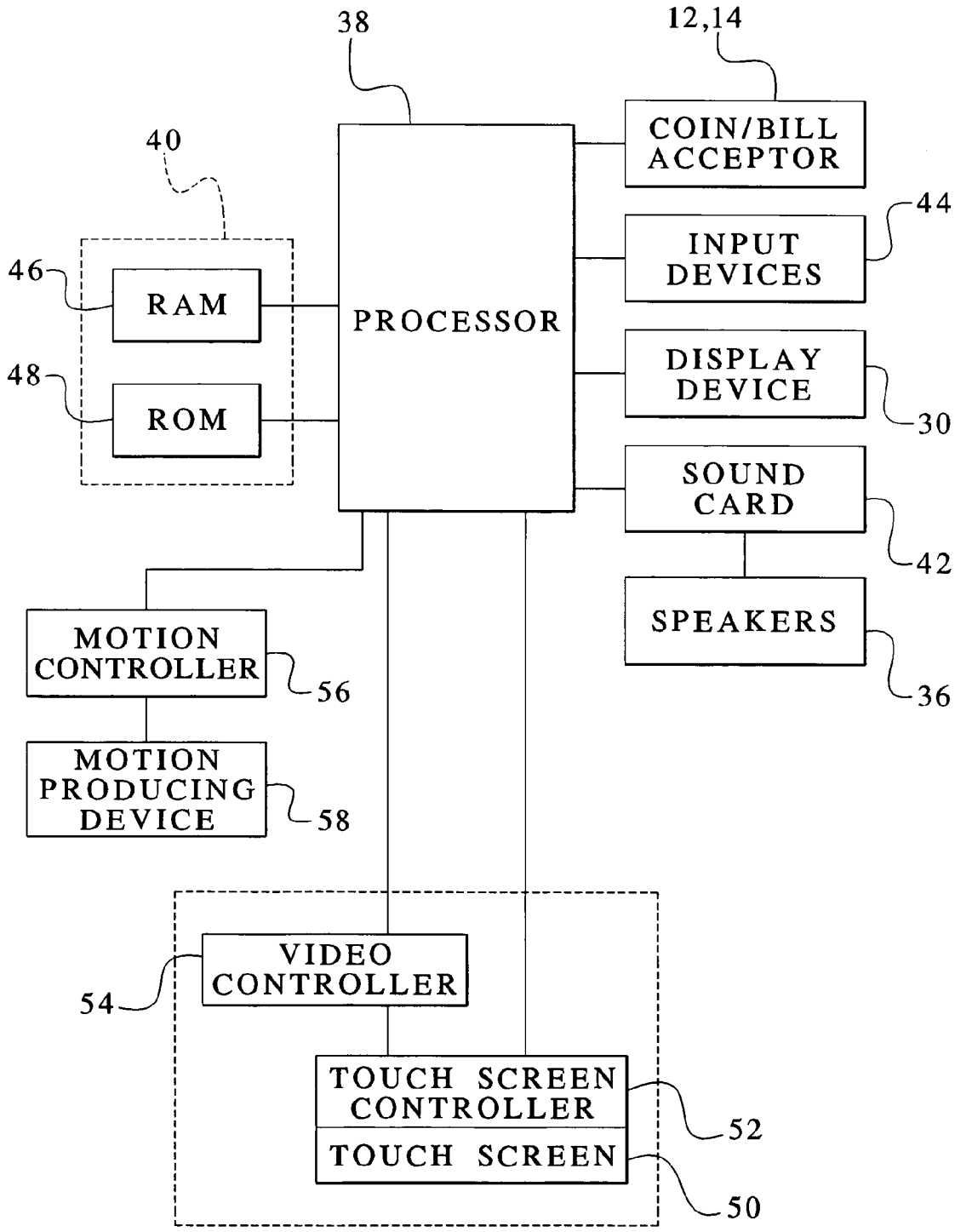
FIG. 4 is a schematic block diagram of the electronic configuration of one embodiment of the gaming device of the present invention.

Referring now to FIG. 4, one embodiment of an electronic configuration for gaming device 10 includes: a processor 38; a memory device 40 for storing program code or other data; a display device 30; a sound card 42; a plurality of speakers 36; and one or more input devices 44 (referring collectively to electromechanical and simulated input devices). The processor 38 includes a platform that is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls gaming device 10 so that it plays a particular game in accordance with applicable game rules and pay tables.

As illustrated in FIG. 4, the player uses the input devices 44 to input signals into gaming device 10. In the slot machine base game, the input devices 44 include the pull arm 18, play button 20, the bet one button 24, the cash out button 26 and other player inputs, such as simulated inputs. In one embodiment, a touch screen 50 and touch screen controller 52 are connected to a video controller 54 and processor 38. The touch screen enables a player to input decisions into the gaming device 10 by sending a discrete signal based on the area of the touch screen 50 that the player touches or presses.

As further illustrated in FIG. 4, the processor 38 connects to the coin slot 12 or payment acceptor 14, whereby the processor 38 requires a player to deposit a certain amount of money to start the game. Although the coin slot 12 and payment acceptor 14 are illustrated alternatively, gaming device 10 provides both coin slot 12 and payment acceptor 14 in one embodiment.

The processor 38 also controls the output of one of more motion controllers 56 that control one or more actuators or motion producing devices 58. The motion producing devices 58 can be any suitable mechanism such as any combination of AC/DC motors, stepper motors, linear stepper motors or other types of linear actuators. The motion producing devices 58 can be electrically or pneumatically operated. The motion controllers 56 are likewise electric or pneumatic controllers.

The motion controllers 56 typically include printed circuit boards or stand alone enclosures that receive high level commands from the processor 38. The motion controller 56 converts the high level commands, for example, into a number of step pulses, which in turn are converted into motor currents. The stepper motor or other type of motion producing device 58 receives the currents, wherein the currents cause, for example, a rotor to turn within a stator a precise and desired amount.

As described more fully below, the rotational motion of a motor 58 can be used to rotate an object 102 of the display device 100 of the present invention. The rotational motion is alternatively converted to cause the object 102 of display device 100 to translate. Otherwise, a linear motion producing device 58 can additionally be employed to directly cause the object 102 of display device 100 to translate.

The motion control scheme facilitates complex movements of multiple parts to be suitably programmed into the memory device 40 and carried out by the processor 38 at the appropriate time in a sequence of the game, be it a base, bonus, bonus triggering or progressive sequence of gaming device 10. The motion control scheme is alternatively stored in one or more motion controllers 56 or a multiplexing motion controller 56. Moreover, multiple programs can be stored and recalled in the memory device 40. In that case, processor 38 runs an appropriate program at the appropriate time so that one or more objects 102, described in more detail below, perform or move differently, e.g., faster, slower or in different directions at different times, at different points in the game and in different sequences.

The motion control programs, in one embodiment, interface with one or more random generation devices, typically software based, to produce randomly displayed outcomes on the displays and indicators of the present invention. For example, processor 38 can run a random selection sequence to produce a result and then command that a particular motion control program be run to achieve or display the result. The random result is therefore determined, in one embodiment, before or during the actual movement of object 102.

FIGS. 1 to 3 illustrate one embodiment of the rotational and translational motion of the display device 100 of the present invention. The display device 100 includes an object 102. In the illustrated embodiments, object 102 is in the form of a hot air balloon. Alternatively, object 102 is any suitable representation of a person, place, thing, symbol, character, animal or any other desired two- or three-dimensional item provided in accordance with a theme of gaming device 10. Object 102 is mounted on a transparent or see-through housing 104. Housing 104 is preferably at least partially made of any suitable transparent or translucent plastic or glass. In one embodiment, housing 104 is acrylic and has a shape somewhat similar to that of a light bulb or the balloon. Housing 104 is transparent or see-through in front, allowing the player to see and view the object or hot air balloon 102. The housing 104 in accordance with the hot air balloon has a rear portion 106 (FIG. 1) that is colored sky colors with clouds, etc. If the object 102 is different than a hot air balloon, housing 104 can have a different shape and have another type of colored background.

Hot air balloon 102 includes a balloon portion 108 a basket 110 attached to the balloon portion by supports such as ropes 112. The supports 112 are rigid or semi-rigid structures such that basket 110 and supports 112 support the balloon portion 108.

Balloon portion 108 of object 102 includes and displays a plurality of symbols 114. In the illustrated embodiment, symbols 114 represent at least a portion of the player's award. That is, the player's award can be equal to one or more of the symbols 114. Or as illustrated, one or more symbols 114 is combined with another award component, such as one or more multipliers 116. One or more of the multipliers 116 is generated randomly for the player, e.g., via a lighted portion of display device 100. Symbols 114 represent any suitable type of award for the player, such as a number of credits, a number of picks from a prize pool, any type of non-monetary award, a free game or a free number of spins and any combination thereof. In an alternative embodiment from that illustrated, the lighted display portion of display device 100 generates one or more credit values for the player, while the rotating and translating object 102 generates one or more multipliers for the player. It should be appreciated that the symbols could alternatively represent other suitable game functions of the gaming device.

Display device 100 includes a suitable indicator 118 such as an arrow or pointer, that designates one of the symbols 114 when object 102 stops rotating. In the illustrated embodiment, indicator 118 is either formed with or attached to housing 104. Indicator 118 is alternatively supported elsewhere within or on display device 100 and alternatively has a different shape than the generally triangular shape of indicator 118 illustrated in FIGS. 1 to 3.

FIG. 1 illustrates object 102 of display device 100 in one of a plurality of rotational positions and in its lowest translational position. In one embodiment, the hot air balloon 102 resides in its lowest position until a triggering event causes motion of the hot air balloon 102 to begin. The motion will cause the balloon to ascend or rise. Alternatively, the balloon can start at the top most position and motion can cause the balloon to descend or fall. Alternatively, the balloon can start at any suitable intermediate position, where the balloon can ascend or descend. As illustrated in FIG. 1, basket 110 is partially seen and partially hidden when the balloon 102 is in its lowest position. In the illustrated embodiment, display device 100 operates with a wagering game such as a slot game. When reels 34 in the slot game spin and come to a stop, a pre-defined symbol or combination of symbols appearing along an activated payline begins the motion of the object 102. Other triggering events or arrangements are possible, such as a symbol appearing on any payline, wagered or not wagered, or upon the play of a certain number of games, etc.

FIG. 2 illustrates the display 100 in an intermediate state. The object or balloon has risen or moved translationally upward so that all of basket 110 is visible. Also, balloon 102 has rotated clockwise (if viewing object 102 from below) so that the symbol 114 of "two hundred" has rotated from a central position illustrated in FIG. 1 to the right-most visible position illustrated in FIG. 2. The symbol 114 of "seventy-five" has likewise rotated behind the "two hundred" symbols 114. Symbols 114 of "five hundred," "forty" and "ten" are visible in the translationally intermediate position of FIG. 2. Those symbols 114 are not visible in FIG. 1. The symbol 114 of "ten" is currently indicated by indicator 118 in FIG. 2.

In one embodiment, balloon portion 108 of object 102 of display device 100 is partitioned into eleven equally sized balloon sections or wedges. In alternative embodiments, object 102 is partitioned into any suitable desired amount of equally or differently sized sections.

The relative translational movement between FIGS. 1 and 2 is illustrated by a distance "D" in FIG. 1 and a distance "D/2" in FIG. 2. The distance "D" represents a total distance that object 102 can traverse. FIG. 2 illustrates that the remaining distance of travel is "D" divided by two or half the distance of "D". Accordingly, FIG. 2 illustrates the object 102 when the object has traveled approximately half way through its total moveable distance.

In one embodiment, in combination with the rotational and translational movement of object 102, display device 100 includes a secondary random event, the outcome of which is combined with the outcome of the mechanical movement to form an overall award for the player. In this embodiment illustrated in FIGS. 1 to 3, display device 100 includes a plurality of illuminable multipliers 116. The illuminable multipliers illuminate sequentially or in combination as desired by the game implementers. At the stage of the display device 100 illustrated in FIG. 2, multiplier 116 of ×6 is illuminated.

FIG. 3 illustrates the object 102 in a final rotational and translational position. Object 102 has rotated during the time between FIGS. 2 and 3 in the same clockwise manner shown between FIGS. 1 and 2. The symbols 114 of "ten" and "forty" have rotated past indicator 118, so that symbol 114 of "five hundred" is indicated. Balloon 102 has also translated further upwardly so that balloon portion 108 is close to the top section of housing 104. In one preferred embodiment, at least a small distance between the balloon portion 108 and housing 104 is maintained so that neither the object 102 nor the housing 104 become damaged. As seen by comparing FIGS. 2 and 3, a further gap is created between basket 110 and a bottom portion of housing 104.

In FIG. 3, the lighting sequence has identified the player's award components 114 and 116 to be five hundred and a multiplier of ×7, respectively. In this embodiment, gaming device 10 at the end of the mechanical and electronic sequence of display device 100 provides an award to the player. In one embodiment, the award is a bonus award triggered by the base game, such as the occurrence of a triggering event displayed on video monitor 30. As seen in FIG. 3, video monitor 30 informs the player that the player has won 3,500 credits. Speakers 36 may also deliver an audio message to the player that the player has won 3,500 credits.

As illustrated, the 3,500 credits provided to the player is a combination of the five hundred credits from the outcome of the rotated and translationally moved object 102 combined with the ×7 multiplier of the sequentially lighted display. In one alternative embodiment, the player's award is based solely on a value identified by object 102. In another embodiment, the symbol 114 is a multiplier that multiplies a number of base game credits, such as the player's wager payline or total wager. In a further embodiment, the multiplier multiplies any other suitable number, such as a number of paylines wagered by the player.

In a further embodiment, multiple indicators 118 are provided that designate multiple ones of the symbols, which are combined, for example, by addition or multiplication. For example, in FIG. 3, multiple indicators 118 could be spread apart to indicate the symbols 114 of "three hundred fifty" and "forty", which could be added in one embodiment to provide an award or an award component of three hundred ninety credits.

Although not illustrated, credit display 16 is eventually updated to reflect the substantial gain made by the player via display 100 in FIGS. 1 to 3. A paid display (not shown) may be provided to show the player how many credits have been downloaded to the player's credit meter. The display of 3,500 credits on video monitor 30 in FIG. 3 can be illustrated counting backwards towards zero, while the player's total credits in credit display 16 count upwards to show an additional 3,500 credits. Speakers 36 provide suitable "credit roll-up" sounds during that exchange of credits.

For ease of illustration, a relatively simple motion sequence is shown in FIGS. 1 to 3. As will become clearer in light of the disclosure below, the rotational and translational motion of the object 102 of display 100 is variable so that many different types of motion profiles are possible. That is, for example, instead of moving upward one time, the translational motion of object 102 alternatively includes multiple starts and stops, one or more direction changes, one or more accelerations and top speeds, one or more dwell periods where no translational movement takes place and any combination thereof. Further, the rotational motion of object 102 is variable to include one or more starts and stops, one or more direction changes, one or more dwell periods, one or more angular accelerations, one or more maximum angular velocities and any combination thereof.

One motion sequence, for example, multiple stepper motors causes the balloon 102 to begin to rise slowly and turn slowly and increasingly accelerate both translationally and rotationally to a maximum point and then decelerate both translationally and rotationally to a stopping point.

It should also be appreciated that any suitable motion control program can be set to repeat (with or without variations) one or more times so that the player may believe that a particular award is being provided, when in fact gaming device 10 changes direction or movement and ultimately provides a different award to the player.

In one embodiment, the player's award is determined randomly before the motion program ends. For example, in FIGS. 1 to 3, gaming device 10 in one embodiment determines randomly to provide an award of 3,500 credits to the player. Thereafter, a plurality of different possibilities exists. In one embodiment, the gaming device 10 determines either randomly or through a set equation, which combination of value(s) and multiplier(s) to use to provide the total award of 3,500 credits to the player. It may be that only a single combination exists that yields such an award. Alternatively, the player could achieve the credit symbol 114 of "three hundred fifty" and a multiplier of ×10 (not illustrated). Alternatively, gaming device 10 randomly generates a first one of the components, which determines or sets the second award component to be a certain value. For example, the object 102 could rotate randomly to display symbol 114 of "three hundred fifty" credits to the player. Thereafter, gaming device 10, knowing the total award to be 3,500 credits, determines that the multiplier has to be an ×10.

In the illustrated embodiment, multipliers 116 are fixed and provided on a front panel of gaming device 10, which does not include a video monitor. Gaming device 10 alternatively provides the multiplier display 116 on a video monitor in one embodiment. That is, the electromechanical portion of display 100 can be a video monitor display similar to video monitor 30, so that the display around housing 104 can change. For example, gaming device 10 in one embodiment changes the values of the multiplier displays 116. In another embodiment, a completely separate type of award component or display is provided. In one implementation, the multipliers are only provided upon certain base game triggering events. For example, a player receiving a first triggering symbol or symbol combination receives an award based only upon symbols 114. A player achieving a second more desirable triggering symbol or symbol combination obtains an award based on credit symbols 114 and multiplier symbols 116.

Figure 5:
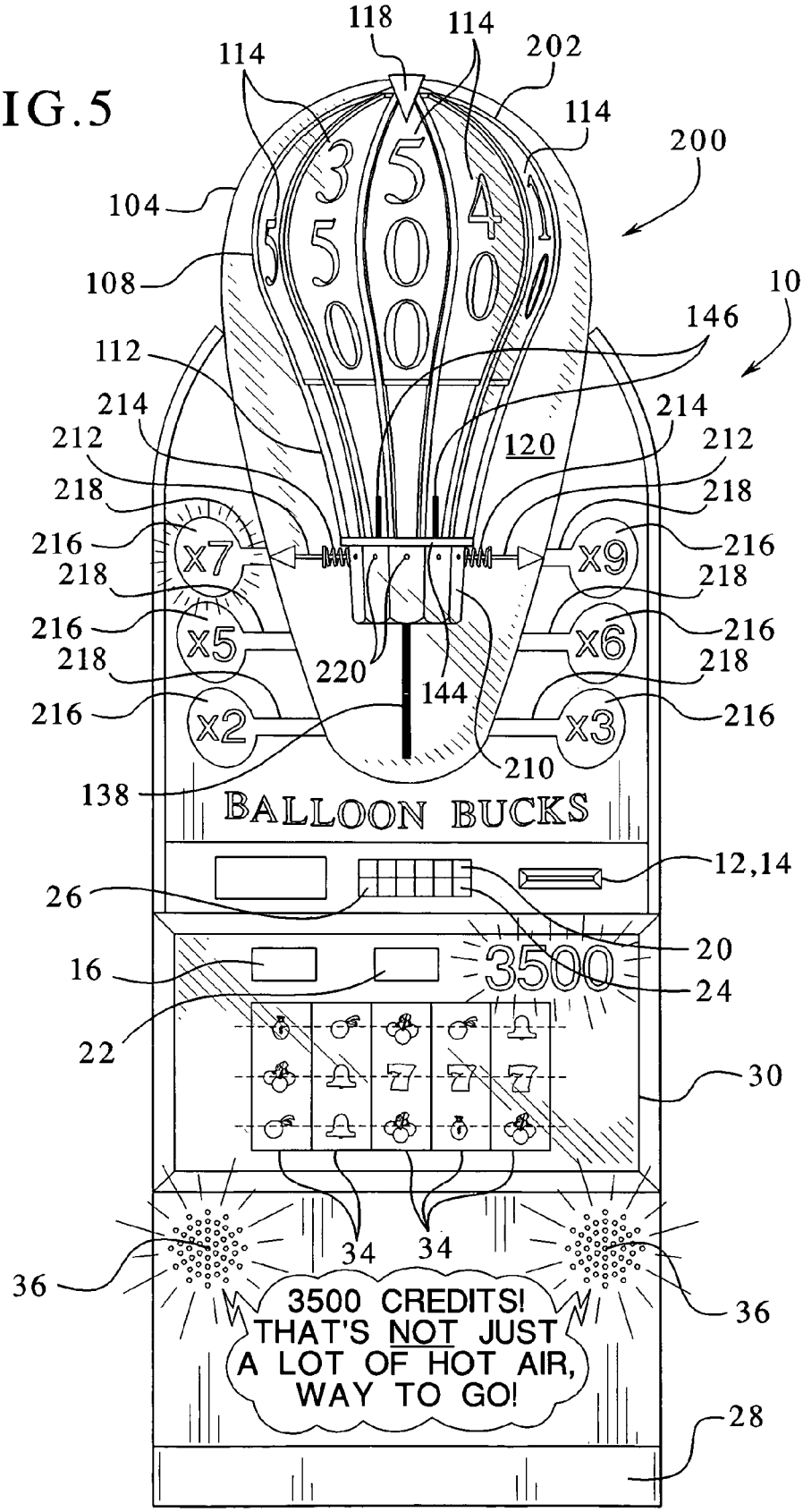
FIGS. 5 and 6 are elevation views of an alternative embodiment of the gaming device illustrated in FIGS. 1 to 3, wherein the rotation of the object determines a first portion of the player's award, while the translation of the object determines a second portion of the player's award.

Referring now to FIG. 5, one alternative embodiment of a display 200 is illustrated, wherein the translational motion of object 202 indicates an award or a component of the player's overall award. Object 202 includes many of the same elements as object 102, including balloon portion 108, ropes 112 and symbols 114. Object 202 includes an alternative basket 210. Basket 210 supports a series of radially extending, spring-loaded indicators 212. There is preferably enough equally spaced apart, radially extending indicators 212, so that the combined indication of indicators 212 is continuous as object 202 translates and rotates (e.g., twelve equally spaced apart indicators 212). Indicators 212 cooperate with springs 214. Springs, 214 push indicators 212 radially outward to touch the inside of housing 104. The tips of indicators can house a ball bearing or roller to reduce the friction between indicators 212 and housing 104. Other suitable indicator configurations are within the scope of the present invention.

The basket 210 defines apertures 220, one for each indicator 212, that enable the indicators 212 to move radially inward as the cross-section of the housing 104 narrows, e.g., as object 202 translates downwardly. Tube sections (not illustrated) can be placed inside basket 210 to surround and support indicators 212 vertically and laterally as the indicators 212 slide radially in and out within the tube sections.

Alternative multipliers 216 are provided that include extensions 218, which are relatively thin and allow multipliers 216 to remain relatively large and at the same time be indicated individually by indicators 212 over a smaller distance of travel. In an alternative embodiment, housing 104 is expanded vertically to allow for a longer distance of vertical travel so that extensions 218 are not needed.

As seen in FIG. 5, object 202 has rotated and translated so that the rotational motion has produced an award of five hundred and the translational motion has produced an award of ×7. Multiplier 216 illuminates accordingly. Those awards are combined to form an overall award of 3500 credits as indicated by display 30 and an audio message from speakers 36. Each of the alternative embodiments described above for the symbols 114 and multipliers 116 described herein is also applicable to the symbols 114 and the multipliers 216 as described in connection with FIG. 5.

Figure 6:
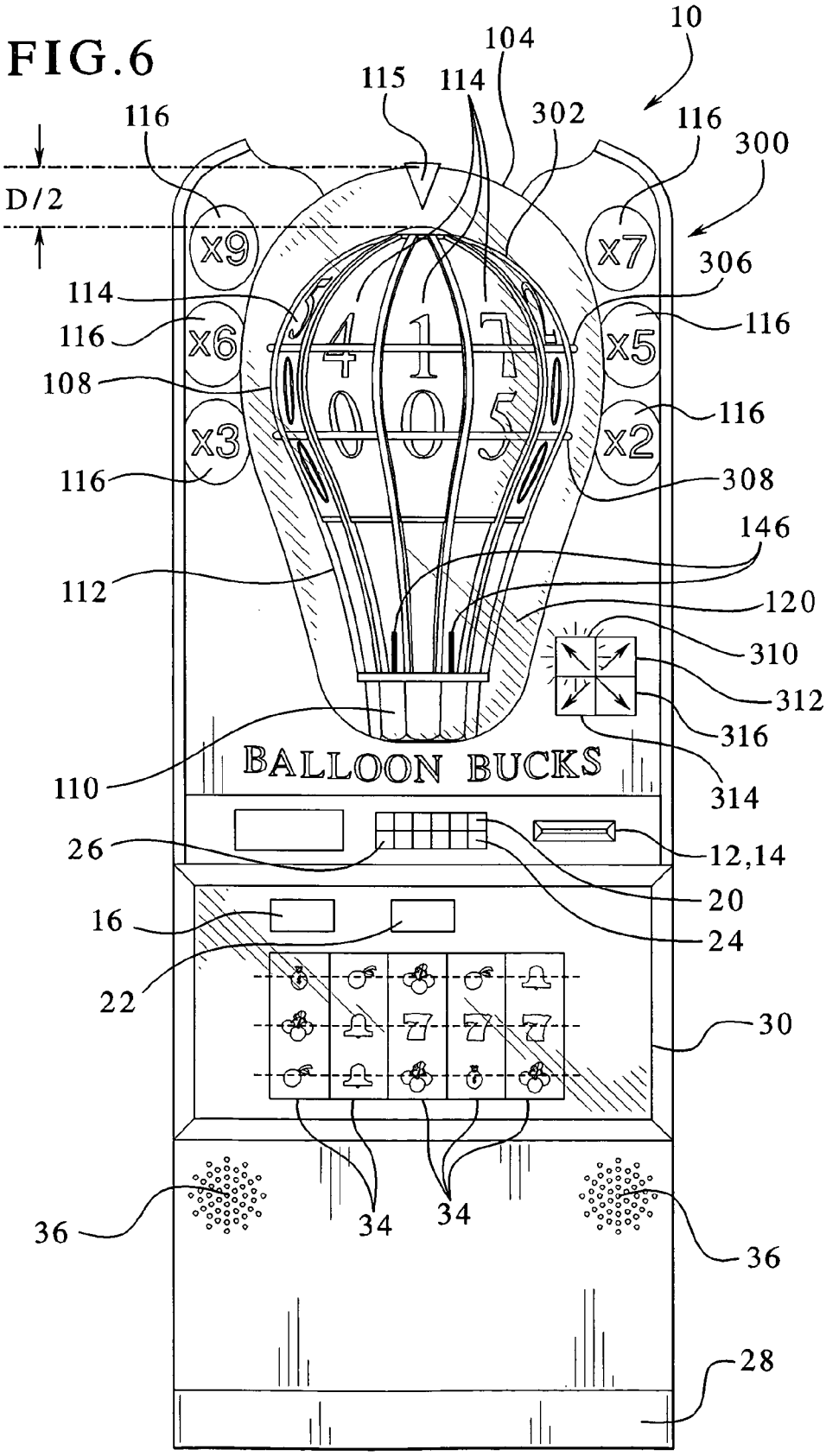

Referring now to FIG. 6, another alternative embodiment is illustrated by display 300, wherein a translational motion of object 302 indicates an award or a component of the player's overall award. Object 302 includes many of the same elements as object 102, including balloon portion 108, ropes 112 and symbols 114. Object 302 includes the same basket 110 as does object 102. Instead of the series of radially extending, spring-loaded indicators 212 of object 202, object 302 includes horizontal indicators 306 and 308. Indicators 306 and 308 are positioned and arranged on object 102 so as to be able to indicate one of the upper multipliers 116 or middle multipliers 116 (for upper indicator 306) and one of the middle multipliers 116 or lower multipliers 116 (for upper indicator 308). That is, as object 302 traverses vertically through its full range of motion, indicator 306 translates to indicate either upper multipliers 116 or middle multipliers 116. Indicator 308 translates to indicate either middle multipliers 116 or lower multipliers 116.

Random generation displays 310 to 316 are provided on gaming device 10 to select randomly between the four quadrants or possible multipliers 116 created by the ultimate translational location of indicators 306 and 308. That is each upper and lower indicator indicates two multipliers when the translational motion of object 302 stops, resulting in four possible multipliers, upper/left, upper/right, lower/left and lower/right. Quadrant displays 310, 312, 314, and 316, one corresponding to each of the four outcome possibilities, select which of the four possibilities is actually provided to the player. In one embodiment a printed circuit board ("PCB") displaying a plurality of light emitting diodes ("LED'S") is provided behind displays 310 to 316. The LED's corresponding to the generated quadrant or multiplier are highlighted, illuminated or otherwise visually communicate the generation. A light sequence may also be provided that shows that gaming device 10 is thinking or generating one of the multipliers 116.

Although not illustrated, the alternative multipliers 216 discussed above may alternatively be used with indicators 116. In a further alternative embodiment, housing 104 is expanded vertically to allow for a longer distance of vertical travel so that additional multipliers 116 may be employed. Further alternatively, only a single horizontal indicator 306 or 308 is used, and only left versus right random generation displays, e.g., displays 310 and 312, are used to pick between the two possibilities yielded by the single horizontal indicator.

As seen in FIG. 5, object 302 has rotated and translated so that the rotational motion has produced an award component of ten and the translational motion has stopped so that Indicator 306 indicates middle multiplier 116 and indicator 308 indicates lower multipliers 116. As seen in FIG. 6, the quadrant generation displays 310 to 316 have generated randomly the upper left quadrant 310 (which is lighted), i.e., the upper indicator 306 and the left side of display 300. The multiplier 116 indicated by upper indicator 306 on the left side of display 300, given the resulting translational position of object 302, is the 6× multiplier 116. The player's overall award in the present example is the generated value ten multiplied by the 6× multiplier or 60, as indicated by display 30 and audio message from speakers 36.

Figure 7:
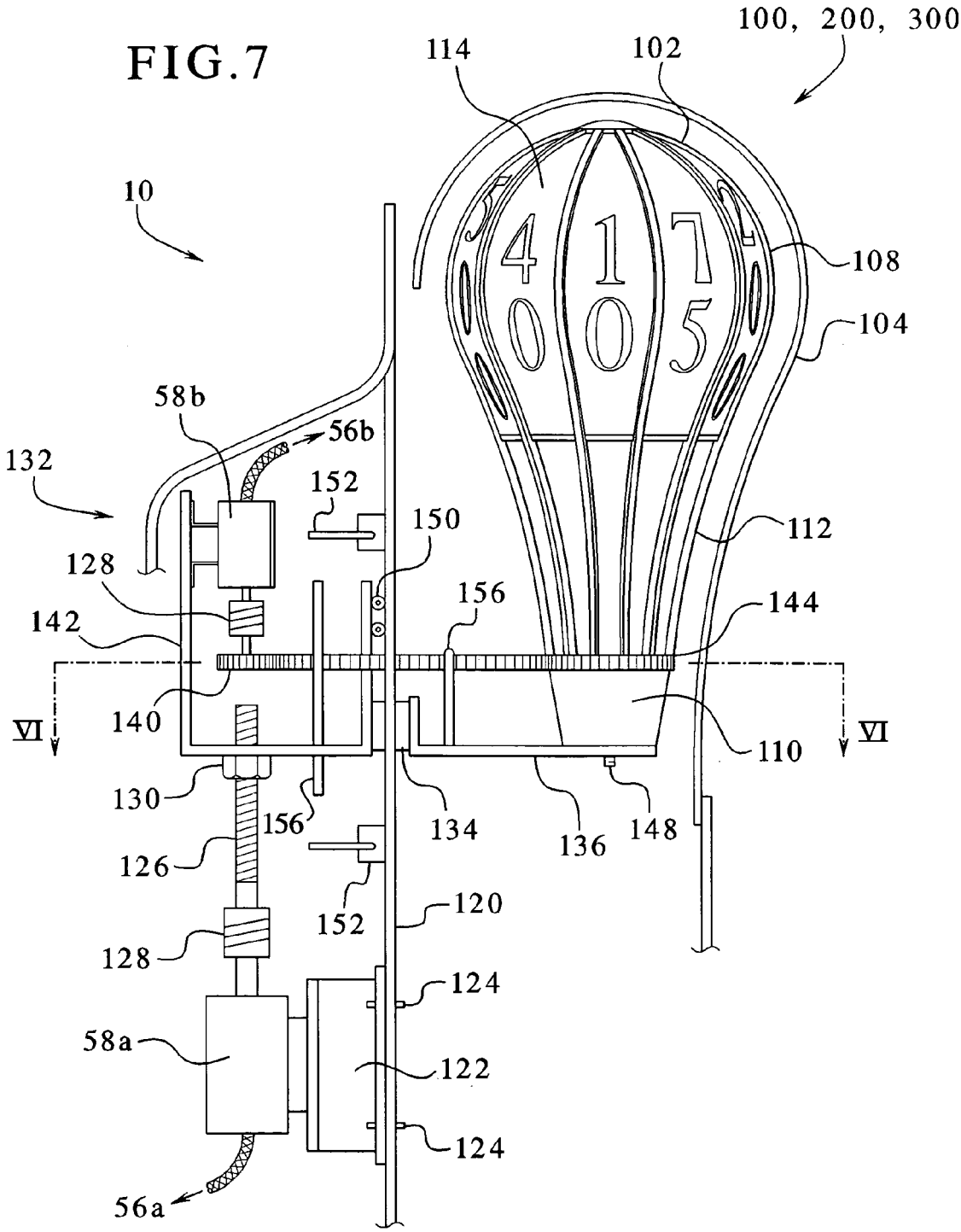
FIG. 7 is a sectioned elevation view showing one possible arrangement for producing the rotational and translational motion of the present invention.
Figure 8:
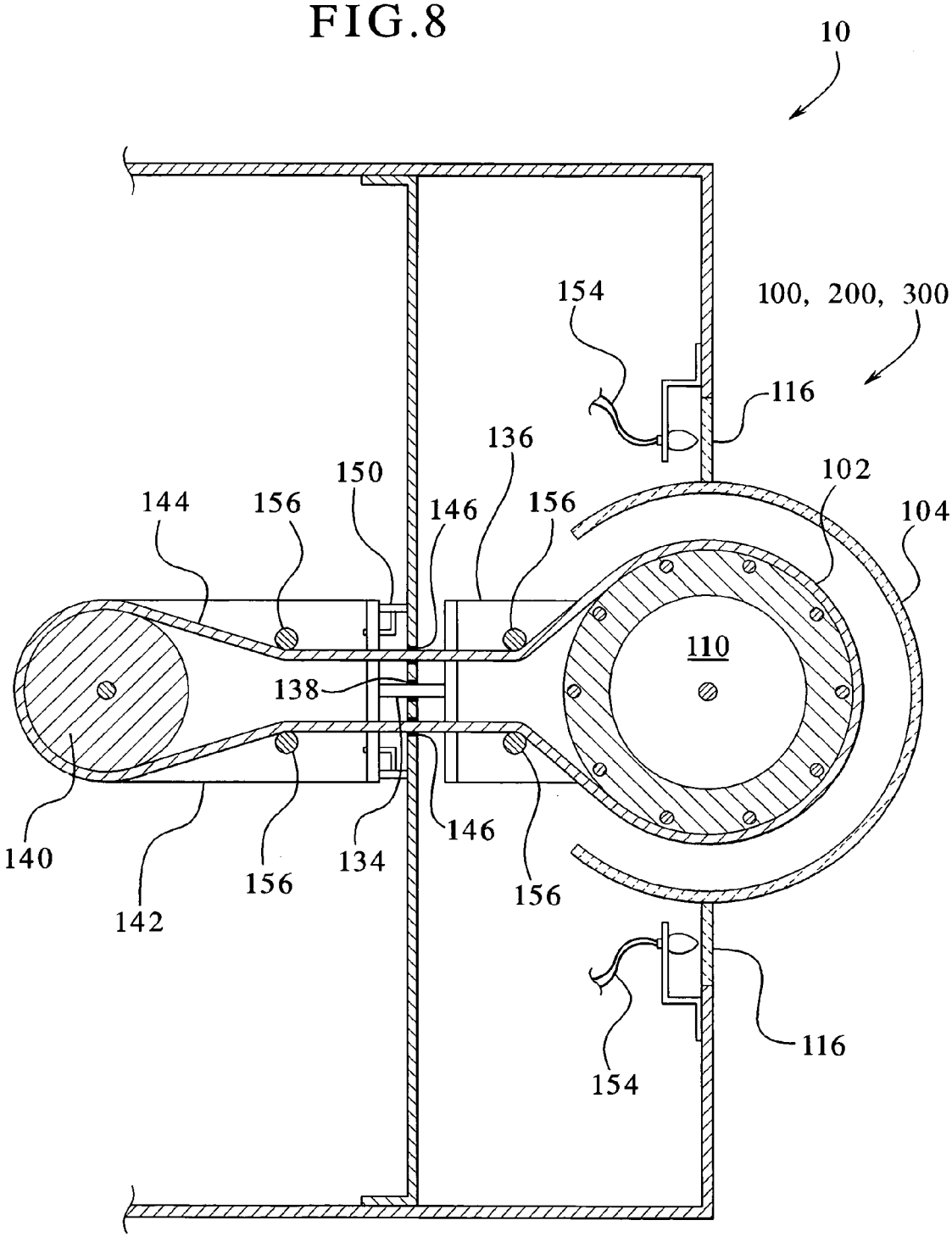
FIG. 8 is a sectioned plan view taken substantially along line VII-VII in FIG. 7.

Referring now to FIGS. 7 and 8, one embodiment for producing the translational and rotational motion of the display device 100 (or device 200) of the present invention is illustrated. FIG. 8 is a sectional view taken substantially along line VII-VII in FIG. 7 and illustrates a top view through an important portion of the motion control apparatus of FIG. 7.

FIGS. 7 and 8 illustrate gaming device 10 having the display 100 shown in FIGS. 1 to 3 or displays 200 and 300 of FIGS. 5 and 6, respectively. FIGS. 7 and 8 show at least a portion of the see-through, clear or acrylic housing 104. FIG. 7 also shows a side view of object or balloon 102 (for ease of description, display 100, object 102, basket 110 and multipliers 116 are described, however, the disclosure is applicable equally to display 200, object 202, baskets 210 and multipliers 216) having the basket 110, supports 112 and balloon portion 108. Symbols 114 are also illustrated. As seen in FIG. 7, the visible portion of display device 100 resides in the upper display or top box area 132. The motion controller 56 and one or more motion producing devices 58 can reside either in the top box area 132 or in the lower cabinet area 32.

A motion producing device 58*a*, seen in FIG. 7, produces the translational motion of the object 102. Motion producing device 58*a* is controlled via one or more wires by a motion controller 56*a*. The rotational motion of the object 102 is produced by a second motion producing device 58*b*, which is controlled via one or more wires by a second controller 56*b*. In one embodiment, the motion producing devices 58*a* and 58*b* are stepper motors (collectively 58), which are highly accurate, positioning type motors. Those motors allow various accelerations, velocities, run times, dwell times, etc., to be programmed into a memory storage device and converted into motor currents via controllers 56 (56*a* and 56*b* are collectively referred to herein as 56) to produce complex desired motion outputs for the output shafts of stepper motors 58.

In an alternative embodiment, the motion producing devices are servo motors that receive a feedback electronically so as to be even more accurate in many cases than stepper motors. In a further alternative embodiment, the motion producing device includes a linear electrical motor that rides along a track or linear stepper motor having an output shaft that moves translationally. In a still further alternative embodiment, the translational motion producing device includes is a pneumatically operated device.

FIG. 7 illustrates separate motion controllers 56*a* and 56*b* for the separate motion producing devices. In an alternative embodiment, a single controller can multitask and control two separate motion producing devices or have two separate processors that are able to run multiple motors. For purposes of illustration, motion producing devices 58*a* and 58*b* are hereinafter described as stepper motors 58*a* and 58*b*.

Translational stepper motor 58*a* is mounted to a back panel 120 via a mount 122 and one or more fastening devices 124. The shaft of stepper motor 58*a* couples to a lead screw 126 via a flexible coupler 128. In one embodiment, lead screw 126 includes a non-threaded portion that fits into coupler 128. Lead screw 126 threads into a nut 130 that is welded to a bracket 142. Bracket 142 is welded to a bridge 134 which in turn is welded to a second bracket 136. Brackets 136 and 142, nut 130 and bridge 134 are metal in one embodiment but could alternatively be hard plastic, formed separately or integrally.

Bridge 134 fits through a slot defined by back panel 120. That slot is labeled 138 in FIG. 3 as is the back panel 120. The illustrated configuration for rotating and translating the object 102 is advantageous in one respect because the components are hidden from the player except for various slots, such as slot 138, which are necessary to allow motion of object 102 to occur. Those slots are relatively easy to cover up via a flexible flap, for example, that is of a color to match the color of back panel 120 where visible to the player.

As the shaft of translational stepper motor 58*a* turns, such rotational motion is transferred via coupler 128 to lead screw 126, which turns within nut 130. Because the motor 58*a* is fixed positionally, the turning of lead screw 136 causes the bracket 142 to translate up or down depending on the direction of rotation of the motor 58*a*. Turning stepper motor 56*a* in one direction causes bracket 142 to move up. Turning stepper motor 56*a* in the opposite direction causes the bracket 142 to move down.

In alternative embodiments, the translational motion of object 102 is side-to-side or at any suitable angle desired by the implementor in an X-Y plane defined by back panel 120. That is, the translational motion produced does not have to be vertical, but instead can be side-to-side or diagonal as desired.

The translational motion of bracket 142 is transferred via bridge 134 to the bracket 136 welded to bridge 134. The bracket 136 pivotally supports the basket 110, rigid supports or ropes 112 and balloon portion 108 of object 102. The player will therefore see the edge of bracket 136. Bracket 136, however, can be machined, painted, colored, textured or otherwise made to appear to be a bottom portion of basket 110 and is therefore either hidden from the player or camouflaged to appear to be part of the basket 110.

Basket 110 and thus object 102 are engaged rotationally with bracket 136 via pivot point 148. Pivot point 148 enables the basket and object 102 to spin freely with respect to bracket 136 and at the same time be supported by and attached to bracket 136. It should be appreciated that when bracket 136 moves up or down, object 102 moves up or down accordingly.

Bracket 142 supports stepper motor 58*b*, which produces the rotational motion of the object 102. When bracket 142 moves up or down, stepper motor 58*b* moves up or down accordingly. Stepper motor 58*b* couples via a second flexible coupler 128 to a pulley 140 (best seen in FIG. 7). Alternatively, shaft 126 has an upper end that is milled to fit into pulley 140, so that a single motor 58*a* produces both the translational motion and rotational motion of object 102. While such an embodiment is more cost effective, the movement of object 102 is limited by such a configuration. In either case, pulley 140 drives a belt 144. Belt 144 extends through slots 146 defined by back panel 120. Slots 146 defined by back plate 120 are also readily concealed as described above with slot 138 defined by back panel 120. Two slots 146 are provided for the belt 144 so that the belt has an exit and return slot as seen in FIG. 8.

Belt 144 extends around a top portion of basket 110 of object 102. When stepper motor 58*b* rotates its shaft, the shaft rotates flexible coupler 128 and pulley 140 coupled thereto, which in turn rotates belt 144, which in turn rotates basket 110 and object 102 about pivot point 148. The motion of object 102 follows the motion of stepper motor 58*b*, including any starts, stops, runs, dwells, direction changes, accelerations, decelerations and velocities, etc. In an embodiment, belt 144 has teeth that engage mating teeth of the pulley as well as mating teeth of an upper strip of the basket 110.

FIGS. 7 and 8 illustrate a series of pegs 156 that attach to and extend from brackets 142 and 136. Pegs 156 are positioned to draw in belt 144 so that belt 144: (i) has more surface area contact with both pulley 140 and a top portion of basket 110; and (ii) so that belt 144 appears to wrap all the way around basket 110. In that manner, the player cannot discern that belt 144 is functional, but instead thinks that belt 144 is an aesthetic characteristic of basket 110. Accordingly, belt 144 is colored or textured to appear to be part of basket 110 of hot air balloon 102.

Suitable rollers and ball bearings are provided in the electromechanical system of the displays 100, 200 and 300 of the present invention. For example, rollers 150 are placed between bracket 142 and the inside surface of back panel 120 to help prevent the assembly from rocking back and forth (i.e., towards and away from the player). Bracket 136 and balloon 102 form a cantilever relative to the translational motor 58*a*. The additional support provided by rollers 150 is therefore desirable. Rollers 150 also serve to provide a smooth translational motion for the object 102 and reduce fluttering and vibrations appearing during such motion, especially during a starting or stopping of the motion of object 102.

Although not illustrated, a circular groove can be made in either or both bracket 136 and basket 110, enabling ball bearings to be placed within the groove between bracket 136 and basket 110, while allowing the basket 110 to remain flush on the surface of bracket 136. The ball bearings placed in such groove allow for balloon 102 to rotate smoothly and also serve to dampen vibrational effects. Still further, and also not illustrated, rollers or bearings are placed between the edges of slot 138 in back panel 120 and the bridge 134. In the same manner that rollers 150 support the assembly and keep same from fluctuating front and back, ball bearings or rollers placed within groove 138 prevent the assembly from rotating or vibrating from side to side relative to the player.

In one embodiment, the translational motion of object 102 is controlled electronically through a motion control program. That is, the game implementor implements a certain amount of step pulses that are fed from motion controller 56*a* to stepper motor 58*a*. When the steps end, the motor stops turning and the object 102 stops translating. It should therefore be appreciated that the motion control program can control the translational motion of the object 102 entirely. It is desirable however to install hard, mechanical limits to compensate for a power down or other type of condition, such as accumulated slippage and backlash along lead screw 126, which causes the object 102 to not be in the position processor 38 or the motor controller 56*a* thinks that the object 102 is in. Accordingly, a plurality limits switches 152 are positioned along the inside of back panel 120, so that one of the pegs 156 (or other protrusion) contacts a limit switch 152 when the bracket 142 and object 102 are translated to a lowest, safest point or to a highest, safest point, respectively. Limit switches 152 in one embodiment are wired in a failsafe manner, so that if one of the wires connecting to limit switch 152 is corrupted (i.e., power to the switch is lost), processor 38 believes that the switch has been triggered and shuts down power to the translational stepper motor 56*a*.

FIG. 8 also illustrates a plan view of the multiplier indicators 116 operating in conjunction with the rotating and translating object 102 positioned inside housing 104. The indicators 116 operate with one or more lights 154 that are controlled by processor 38 to selectively light one or more desired multiplier indicators 116 at a specified time. As stated above, one or more lights 154 for one or more multipliers 116 may be lit simultaneously or sequentially. For ease of illustration, a single lamp 154 is provided for each indicator 116. In an alternative embodiment, multiple lamps, surrounding the multiplier, for example, are provided. Lamp 154 in one embodiment includes a printed circuit board. Further, lights 154 are shown inside of the front panel of gaming device 10 so as to provide backlight for the multipliers 116. In an alternative embodiment, the lights mount through the front panel and highlight, for example, the area around the multipliers 116.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

a game operable upon a wager by a player;

a cabinet including a plurality of displayed first symbols, each associated with a value, the first symbols being displayed as stationary relative to the cabinet, the first symbols arranged such that a majority of the first symbols are displayed in a sequential order on the cabinet based on the values associated with the first symbols;

a display mounted in said cabinet and operable to display said game;

an object rotatably connected to said cabinet, said object having a plurality of second symbols, wherein at least one of the second symbols is indicated to the player as the object is rotated;

a motion producing device mounted in said cabinet; and a processor in communication with said motion producing device and operable to:

(a) cause the object to translate along a substantially vertically extending axis;

(b) cause the object to rotate about said substantially vertically extending axis; and (c) display an outcome to the player based on:

(i) at least one of the first symbols indicated after said object is translated; and (ii) at least one of the second symbols indicated after said object is rotated.

2. The gaming device of claim 1, wherein the motion producing device includes a stepper motor.

3. The gaming device of claim 1, wherein a designated plurality of the displayed first symbols are modifier symbols.

4. The gaming device of claim 1, wherein the motion producing device includes a first motion producing device and includes a second independent motion producing device operable to cause the object to rotate.

5. The gaming device of claim 1, wherein the motion producing device is also operable to cause the object to rotate.

6. The gaming device of claim 1, wherein the processor executes a motion control program to control operation of the motion producing device.

7. The gaming device of claim 1, which includes at least one electrical switch operable to control operation of the motion producing device.

8. The gaming device of claim 1, wherein the designated symbol is generated before the rotation and translation of the object stops.

9. The gaming device of claim 1, wherein the outcome is based on a second determination combined with the indicated first and second symbols.

10. The gaming device of claim 1, which includes a lighted display connected to the cabinet in proximity to the object, wherein the lighted display is operable to designate another component of the outcome.

11. The gaming device of claim 1, wherein the object is positioned in an at least partially see-through housing connected to the cabinet.

12. The gaming device of claim 1, wherein the object is balloon shaped.

13. The gaming device of claim 1, wherein the motion producing device operates the object upon an event in the game.

14. A gaming device comprising:

a cabinet including a plurality of displayed first symbols, each associated with a value, the first symbols being displayed as stationary relative to the cabinet, the first symbols arranged such that a majority of the first symbols are displayed in a sequential order on the cabinet based on the values associated with the first symbols;

a first display device positioned in the cabinet;

a second display device attached to the cabinet;

a game operable upon a wager by a player, the game displayed by the first display device and operable to cause the operation of an object, the object having a plurality of second symbols, the second symbols are indicated to the player as the object is rotated about a substantially vertically extending axis;

a motion producing device; and at least one processor in communication with said first display device and said motion producing device, the at least one processor operable to cause the object to translate substantially along said substantially vertically extending axis to indicate one of the first symbols to the player.

15. The gaming device of claim 14, wherein the game is (i) selected from the group consisting of: slot, poker, blackjack, keno, craps, bingo, bunco and any combination thereof or (ii) a bonus game of a primary game selected from the group consisting of: slot, poker, blackjack, keno, craps, bingo, bunco and any combination thereof.

16. The gaming device of claim 14, wherein the at least one processor is operable to display an award, the award based on the indicated one of the first symbols and an indicated second symbol.

17. The gaming device of claim 14, wherein the game includes a primary game operated on the first display device and a secondary game displayed by the object.

18. The gaming device of claim 14, wherein the object is balloon shaped.

19. A gaming device comprising:

a cabinet including a plurality of displayed first symbols, each associated with a value, the first symbols being displayed as stationary relative to the cabinet, the first symbols arranged such that a majority of the first symbols are displayed in a sequential order on the cabinet based on the values associated with the first symbols;

a game operable upon a wager by a player; and a display device attached to the cabinet and operable upon an event in the game, the display device including:

(a) an object having a plurality of displayed second symbols;

(b) a first indicator operable to indicate sequentially to the player one of the second symbols as the object is rotated about a substantially vertically extending axis; and (c) a second indicator operable to indicate sequentially each one of the first symbols as the object is translated along said substantially vertically extending axis; and an outcome provided to the player that is based on at least one of an indicated first symbol and an indicated second symbol.

20. The gaming device of claim 19, wherein the outcome is provided after the object has stopped rotating and translating.

21. The gaming device of claim 19, wherein the outcome includes the indicated first symbol multiplied by the indicated second symbol.

22. A method of operating a gaming device having a game operable upon a wager by a player, said method comprising:

(a) displaying a plurality of first symbols as stationary relative to a cabinet, each of the first symbols associated with a value, the first symbols arranged such that a majority of the first symbols are displayed in a sequential order on the cabinet based on the values associated with the first symbols;

(b) displaying a plurality of second symbols to a player by rotating an object about substantially vertically extending axis;

(c) translating at the same time the object substantially along substantially vertically extending while at least one of the symbols is displayed to the player; and displaying an outcome to a player based on:

(i) at least one of the second symbols indicated after the object is rotated; and (ii) at least one of the first symbols indicated after the object is translated.

23. The method of claim 22, which includes rotating the object at a time when the object is not translating.

24. The method of claim 22, which includes translating the object at a time when the object is not rotating.

25. The method of claim 22, which includes rotating the object in a plurality of directions.

26. The method of claim 22, which includes translating the object in a plurality of directions.

27. The method of claim 22, which includes generating a multiplier and combining the multiplier with the designated symbol to determine the outcome provided to the player.

28. The method of claim 22, which includes determining the outcome based on a designated plurality of the symbols of the object.

29. A method of operating a gaming device having a game operable upon a wager by a player, said method comprising:

rotating an object about a substantially vertically extending axis, the rotation relative to a stationary portion of a cabinet;

translating the object along said substantially vertically extending axis while rotating the object;

stopping the rotation so that a first component of an outcome is indicated based at least in part on an orientation of the object relative to the stationary portion of the cabinet;

stopping the translation so that a second component of the outcome is indicated based at least in part on a position of the object relative to the stationary portion of the cabinet, wherein the second component of the outcome is:

(i) associated with a lowest value at a first position, and (ii) associated with sequentially higher values as the object is translated farther away from the first position;

combining the first and second outcome components to form the outcome; and displaying the outcome to the player.

30. The method of claim 29, which includes rotating the object at a time when the object is not translating.

31. The method of claim 29, which includes translating the object at a time when the object is not rotating.

* * * * *

UNITED STATES PATENT AND TRADEMARK OFFICE

CERTIFICATE OF CORRECTION

PATENT NO. : 7,438,641 B2
APPLICATION NO. : 10/956294
DATED : October 21, 2008
INVENTOR(S) : Joseph R. Hedrick It is certified that error appears in the above-identified patent and that said Letters Patent is hereby corrected as shown below:

IN THE CLAIMS:

In Claim 22, Column 17, Line 5 change "along substantially" to --along said substantially--.

In Claim 22, Column 17, Line 5 change "extending while" to --extending axis while--.

Signed and Sealed this

Twenty-third Day of December, 2008

JON W. DUDAS
*Director of the United States Patent and Trademark Office*